US006247535B1

(12) United States Patent
Pringle et al.

(10) Patent No.: US 6,247,535 B1
(45) Date of Patent: Jun. 19, 2001

(54) ORIENTING AND LOCKING SWIVEL AND METHOD

(75) Inventors: Ronald E. Pringle, Houston; Clay W. Milligan, Jr., Missouri City, both of TX (US)

(73) Assignee: Camco International Inc., Houston, TX (US)

( * ) Notice: Subject to any disclaimer, the term of this patent is extended or adjusted under 35 U.S.C. 154(b) by 0 days.

(21) Appl. No.: 09/396,234

(22) Filed: Sep. 15, 1999

Related U.S. Application Data

(60) Provisional application No. 60/101,340, filed on Sep. 22, 1998.

(51) Int. Cl.[7] ..... E21B 17/05

(52) U.S. Cl. ..... 166/89.1; 403/78; 285/141; 285/190; 285/277

(58) Field of Search ..... 166/89.1, 242.6, 166/381; 403/78; 285/122, 141, 190, 277

(56) References Cited

U.S. PATENT DOCUMENTS

| | | | |
|---|---|---|---|
| 3,863,959 | | 2/1975 | Blaschke . |
| 4,118,838 | | 10/1978 | Schiefer et al. . |
| 4,128,127 | | 12/1978 | Taylor . |
| 4,607,865 | | 8/1986 | Hughes . |
| 4,616,537 | | 10/1986 | Axford et al. . |
| 4,667,743 | * | 5/1987 | Ringgenberg et al. . |
| 4,681,166 | | 7/1987 | Cuiper . |
| 4,753,291 | | 6/1988 | Smith et al. . |
| 4,756,559 | | 7/1988 | Shimada et al. . |
| 4,907,828 | | 3/1990 | Chang . |
| 4,989,902 | | 2/1991 | Putch . |
| 5,086,845 | * | 2/1992 | Baugh . |
| 5,101,915 | | 4/1992 | Witte . |
| 5,139,090 | | 8/1992 | Land . |
| 5,248,004 | | 9/1993 | Witte et al. . |
| 5,327,975 | * | 7/1994 | Land . |
| 5,373,906 | | 12/1994 | Braddick . |
| 5,468,153 | | 11/1995 | Brown et al. . |
| 5,474,334 | | 12/1995 | Eppink . |

FOREIGN PATENT DOCUMENTS

| | | |
|---|---|---|
| WO 98/29637 | 9/1998 | (WO) . |
| WO 00/17480 | 3/2000 | (WO) . |

* cited by examiner

*Primary Examiner*—Roger Schoeppel
(74) *Attorney, Agent, or Firm*—Goldstein & Healey

(57) ABSTRACT

In a broad aspect, the invention is an orienting and locking swivel including: a locking ratchet housing having a longitudinal bore; a first tubular member partially disposed within the longitudinal bore of the locking ratchet housing; a second tubular member partially disposed within the longitudinal bore of the locking ratchet housing, and releasably engageable with the locking ratchet housing; a first split housing engaged with the locking ratchet housing and releasably engageable with the first tubular member; and a second split housing engaged with the locking ratchet housing and releasably engageable with the second tubular member. The swivel may further include a locking ratchet disposed within a locking ratchet recess in the locking ratchet housing. A method of orienting a plurality of eccentric well tools is also provided, as is a downhole well assembly.

43 Claims, 9 Drawing Sheets

ORIENTING AND LOCKING SWIVEL AND METHOD

This application claims the benefit of U.S. Provisional Patent Application Ser. No. 60/101,340 filed on Sep. 22, 1998.

BACKGROUND OF THE INVENTION

1. Field Of The Invention

The present invention relates to subsurface well equipment and, more particularly, to an apparatus and related method for aligning eccentric well tools that are connected to a well tubing.

2. Description Of The Related Art

As is well known, after an oil and gas well is drilled, casing is cemented in place therein. Thereafter, various well tools may be lowered into the well casing for a variety of purposes. It is not uncommon for the well tools to be connected to a production or well tubing, which is made up of many separate sections of tubing that are threadably connected together. The well tools are threadably connected between sections of well tubing at desired locations. Well tools normally have a generally tubular cross section, most of which are generally symmetrical, but some of which are eccentric. For example, a side pocket mandrel has a generally tubular portion and a side pocket that results in an eccentric cross section. When two or more side pocket mandrels are connected in a tubing string, it is desirable to align the side pockets so as to minimize outside diameters and make the most efficient use of the space within the casing, especially when two side pocket mandrels are not spaced very far apart. In this regard, if two side pocket mandrels are spaced a sufficient distance from one another, then it may be possible to fit them within the casing, even though their respective side pockets are misaligned, provided that the intermediate section of tubing string between the two side pocket mandrels can be sufficiently bent without permanent deformation thereof. It is further desirable to align the side pocket mandrels so that their respective generally tubular portions (or longitudinal production bores through which well fluids flow) are substantially coaxial with the production bore of the intermediate tubing string, thereby resulting in a "straight," as opposed to a "crooked," production bore. It may also be desirable to align the side pockets to facilitate the connection of control lines from the surface to downhole tools that employ "smart" or "intelligent" technology, as those terms are known in the art. As will be more fully described below, the present invention is an orienting and locking swivel that meets these needs, may be connected to the well tubing between two side pocket mandrels, and used to align the side pockets and lock them in that aligned orientation.

SUMMARY OF THE INVENTION

The present invention has been contemplated to meet the above described needs. In one aspect, the invention may be an orienting and locking swivel, comprising: a locking ratchet housing having a locking ratchet recess and a longitudinal bore; a locking ratchet disposed within the locking ratchet recess and releasably secured to the locking ratchet housing; a first tubular member partially disposed within the longitudinal bore of the locking ratchet housing, and releasably engageable with the locking ratchet; a second tubular member partially disposed within the longitudinal bore of the locking ratchet housing, and releasably engageable with the locking ratchet; a first split housing engaged with the locking ratchet housing and releasably engageable with the first tubular member; and a second split housing engaged with the locking ratchet housing and releasably engageable with the second tubular member. Another feature of this aspect of the present invention is that the locking ratchet housing is eccentric. Another feature of this aspect of the present invention is that the first and second split housings are eccentric. Another feature of this aspect of the present invention is that the locking ratchet housing further includes a first tubular extension having a first flange and a second tubular extension having a second flange, the first flange being disposed with an arcuate recess in the first split housing, and the second flange being disposed within an arcuate recess in the second split housing. Another feature of this aspect of the present invention is that at least one of the first tubular extension, the first flange, the second tubular extension, and the second flange is eccentric. Another feature of this aspect of the present invention is that the locking ratchet is releasably compressed against the first and second tubular members by at least one locking ratchet fastener. Another feature of this aspect of the present invention is that the swivel may further include means for releasably compressing the locking ratchet against the first and second tubular members. Another feature of this aspect of the present invention is that the locking ratchet includes a plurality of ratchet teeth releasably engageable with a plurality of ratchet teeth on at least one of the first and second tubular members. Another feature of this aspect of the present invention is that the plurality of ratchet teeth on the locking ratchet are disposed on a concave surface of the locking ratchet. Another feature of this aspect of the present invention is that the swivel may further include means for biasing the locking ratchet teeth into engagement with the ratchet teeth on the first and second tubular members. Another feature of this aspect of the present invention is that the swivel may further include means for disengaging the locking ratchet from the first and second tubular members. Another feature of this aspect of the present invention is that the swivel may further include at least one split ring disposed within (a) at least one arcuate recess in at least one of the first and second split housings and (b) at least one annular recess in at least one of the first and second tubular members. Another feature of this aspect of the present invention is that at least one of the first and second split rings is eccentric. Another feature of this aspect of the present invention is that the first and second tubular members are substantially coaxially aligned. Another feature of this aspect of the present invention is that the first split housing includes a first main body and a first mating body, each having a first concave surface for mating with the first tubular member and a second concave surface for mating with a first tubular extension on the locking ratchet housing, and the second split housing includes a second main body and a second mating body, each having a first concave surface for mating with the second tubular member and a second concave surface for mating with a second tubular extension on the locking ratchet housing. Another feature of this aspect of the present invention is that the first main body and the first mating body are releasably secured together about the first tubular member, and the second main body and the second mating body are releasably secured together about the second tubular member. Another feature of this aspect of the present invention is that the first split housing includes a locking finger for cooperable engagement with a first locking notch on the locking ratchet housing, and the second split housing includes a locking finger for cooperable engagement with a second locking notch on the locking ratchet housing. Another feature of this aspect of the present invention is that the swivel may further include at least one longitudinal passageway disposed therein for passage of at least one control line.

In another aspect, the present invention may be an orienting and locking swivel, comprising: a locking ratchet housing having a locking ratchet recess and a longitudinal bore; a locking ratchet disposed within the locking ratchet recess, and having a plurality of ratchet teeth disposed thereon; a first tubular member having a plurality of ratchet teeth releasably engageable with the plurality of ratchet teeth on the locking ratchet, and being partially disposed within the longitudinal bore of the locking ratchet housing; a second tubular member having a plurality of ratchet teeth releasably engageable with the plurality of ratchet teeth on the locking ratchet, and being partially disposed within the longitudinal bore of the locking ratchet housing; a first split housing engaged with the locking ratchet housing, and having a first main body and a first mating body, each of the first main body and first mating body having a first concave surface for mating with the first tubular member and a second concave surface for mating with a first tubular extension of the locking ratchet housing; and a second split housing engaged with the locking ratchet housing, and having a second main body and a second mating body, each of the second main body and second mating body having a first concave surface for mating with the second tubular member and a second concave surface for mating with a second tubular extension of the locking ratchet housing. Another feature of this aspect of the present invention is that the locking ratchet housing is eccentric. Another feature of this aspect of the present invention is that the first and second split housings are eccentric. Another feature of this aspect of the present invention is that the first tubular extension further includes a first flange and the second tubular extension further includes a second flange, the first flange being disposed with arcuate recesses in the first main body and the first mating body, and the second flange being disposed within arcuate recesses in the second main body and the second mating body. Another feature of this aspect of the present invention is that at least one of the first tubular extension, the first flange, the second tubular extension, and the second flange is eccentric. Another feature of this aspect of the present invention is that the swivel may further include a first and a second split ring, the first split ring being disposed within an annular recess in the first tubular member and within at least one arcuate recess in one of the first main body and the first mating body, and the second split ring being disposed within an annular recess in the second tubular member and within at least one arcuate recess in one of the second main body and the second mating body. Another feature of this aspect of the present invention is that at least one of the first and second split rings is eccentric. Another feature of this aspect of the present invention is that the first main body and the first mating body are releasably secured together about the first tubular member, and the second main body and the second mating body are releasably secured together about the second tubular member. Another feature of this aspect of the present invention is that the first split housing includes a locking finger for cooperable engagement with a first locking notch on the locking ratchet housing, and the second split housing includes a locking finger for cooperable engagement with a second locking notch on the locking ratchet housing. Another feature of this aspect of the present invention is that the locking ratchet is releasably compressed against the first and second tubular members by at least one locking ratchet fastener. Another feature of this aspect of the present invention is that the swivel may further include means for releasably compressing the locking ratchet against the first and second tubular members. Another feature of this aspect of the present invention is that the plurality of ratchet teeth on the locking ratchet are disposed on a concave surface of the locking ratchet. Another feature of this aspect of the present invention is that the swivel may further include means for biasing the locking ratchet teeth into engagement with the ratchet teeth on the first and second tubular members. Another feature of this aspect of the present invention is that the swivel may further include means for disengaging the locking ratchet from the first and second tubular members. Another feature of this aspect of the present invention is that the first and second tubular members are substantially coaxially aligned. Another feature of this aspect of the present invention is that the swivel may further include at least one longitudinal passageway disposed therein for passage of at least one control line.

In yet another aspect, the present invention may be an orienting and locking swivel, comprising: a locking ratchet housing having a longitudinal bore; a first tubular member partially disposed within the longitudinal bore of the locking ratchet housing, and releasably engageable with the locking ratchet housing; a second tubular member partially disposed within the longitudinal bore of the locking ratchet housing, and releasably engageable with the locking ratchet housing; a first split housing engaged with the locking ratchet housing and releasably engageable with the first tubular member; and a second split housing engaged with the locking ratchet housing and releasably engageable with the second tubular member. Another feature of this aspect of the present invention is that the swivel may further include means for releasably engaging the first and the second tubular members with the locking ratchet housing. Another feature of this aspect of the present invention is that the swivel may further include means connected to the first and the second tubular members for transferring loads between the first and the second tubular members. Another feature of this aspect of the present invention is that the swivel may further include means connected to the locking ratchet housing for transferring loads between the first and the second tubular members. Another feature of this aspect of the present invention is that the swivel may further include a locking ratchet disposed within a locking ratchet recess in the locking ratchet housing, the locking ratchet being releasably engageable with the first and second tubular members. Another feature of this aspect of the present invention is that the locking ratchet includes a plurality of ratchet teeth releasably engageable with a plurality of ratchet teeth on at least one of the first and second tubular members. Another feature of this aspect of the present invention is that the first split housing includes a first main body and a first mating body, each having a first concave surface for mating with the first tubular member and a second concave surface for mating with a first tubular extension on the locking ratchet housing, and the second split housing includes a second main body and a second mating body, each having a first concave surface for mating with the second tubular member and a second concave surface for mating with a second tubular extension on the locking ratchet housing. Another feature of this aspect of the present invention is that the first split housing includes a locking finger for cooperable engagement with a first locking notch on the locking ratchet housing, and the second split housing includes a locking finger for cooperable engagement with a second locking notch on the locking ratchet housing.

In still another aspect, the present invention may be a method of orienting and locking a first and a second eccentric well tool in a tubing string disposed within a well casing, comprising: connecting the first eccentric well tool to the tubing string; connecting the second eccentric well tool to the tubing string; rotating the second eccentric well tool into alignment with the first eccentric well tool; and preventing relative rotation between the first and second eccentric well tools. Another feature of this aspect of the present invention is that the method may further include connecting at least one section of well tubing between the first and second eccentric well tools. Another feature of this aspect of the present invention is that the method may further include substantially coaxially aligning respective longitudinal production bores of the first eccentric well tool, the second eccentric well tool, and an intermediate section of the tubing string between the first and second eccentric well tools.

In another aspect, the present invention may be a downhole well assembly, comprising: a first eccentric well tool having a longitudinal production bore therethrough; a second eccentric well tool having a longitudinal production bore therethrough; and at least one section of well tubing connected between the first and second well tools, and having a longitudinal production bore therethrough, the eccentric well tools being aligned, and the longitudinal production bores of the eccentric well tools and the at least one section of well tubing being substantially coaxially aligned. Another feature of this aspect of the present invention is that the first eccentric well tool is a first side pocket mandrel having a first side pocket, the second eccentric well tool is a second side pocket mandrel having a second side pocket, and one of the first and second side pockets is aligned with and disposed directly above the other of the first and second side pockets. Another feature of this aspect of the present invention is that the at least one section of well tubing is a single section of well tubing. Another feature of this aspect of the present invention is that the assembly may further include means connected between the first and second eccentric well tools for locking and orienting the first and second eccentric well tools in the tubing string.

While the invention will be described in connection with the preferred embodiments, it will be understood that it is not intended to limit the invention to those embodiments. On the contrary, it is intended to cover all alternatives, modifications, and equivalents as may be included within the spirit and scope of the invention as defined by the appended claims.

DETAILED DESCRIPTION OF THE INVENTION

Figure 1A:
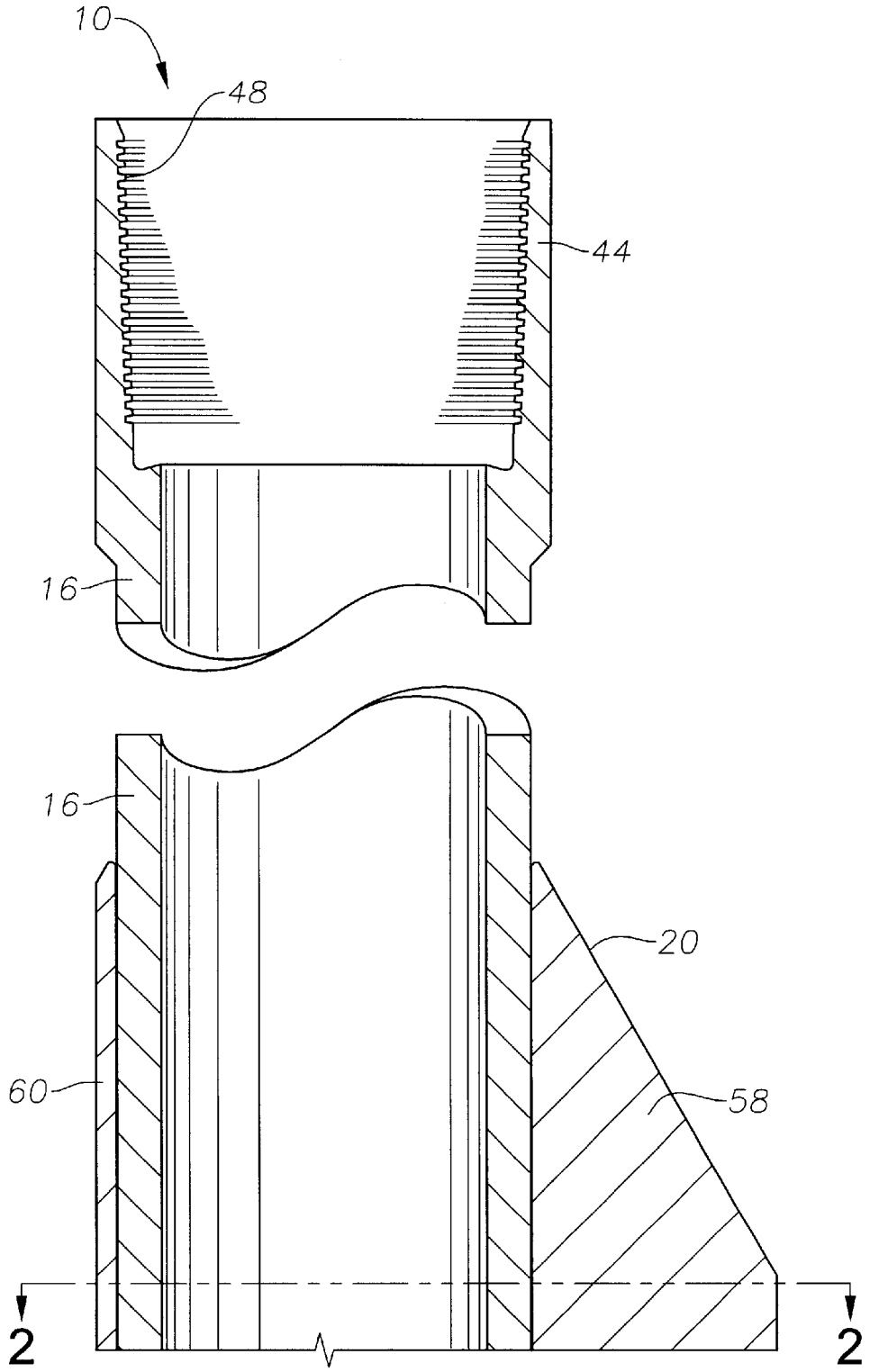
FIGS. 1A–1C illustrate a longitudinal cross-sectional view of the present invention.
Figure 1B:
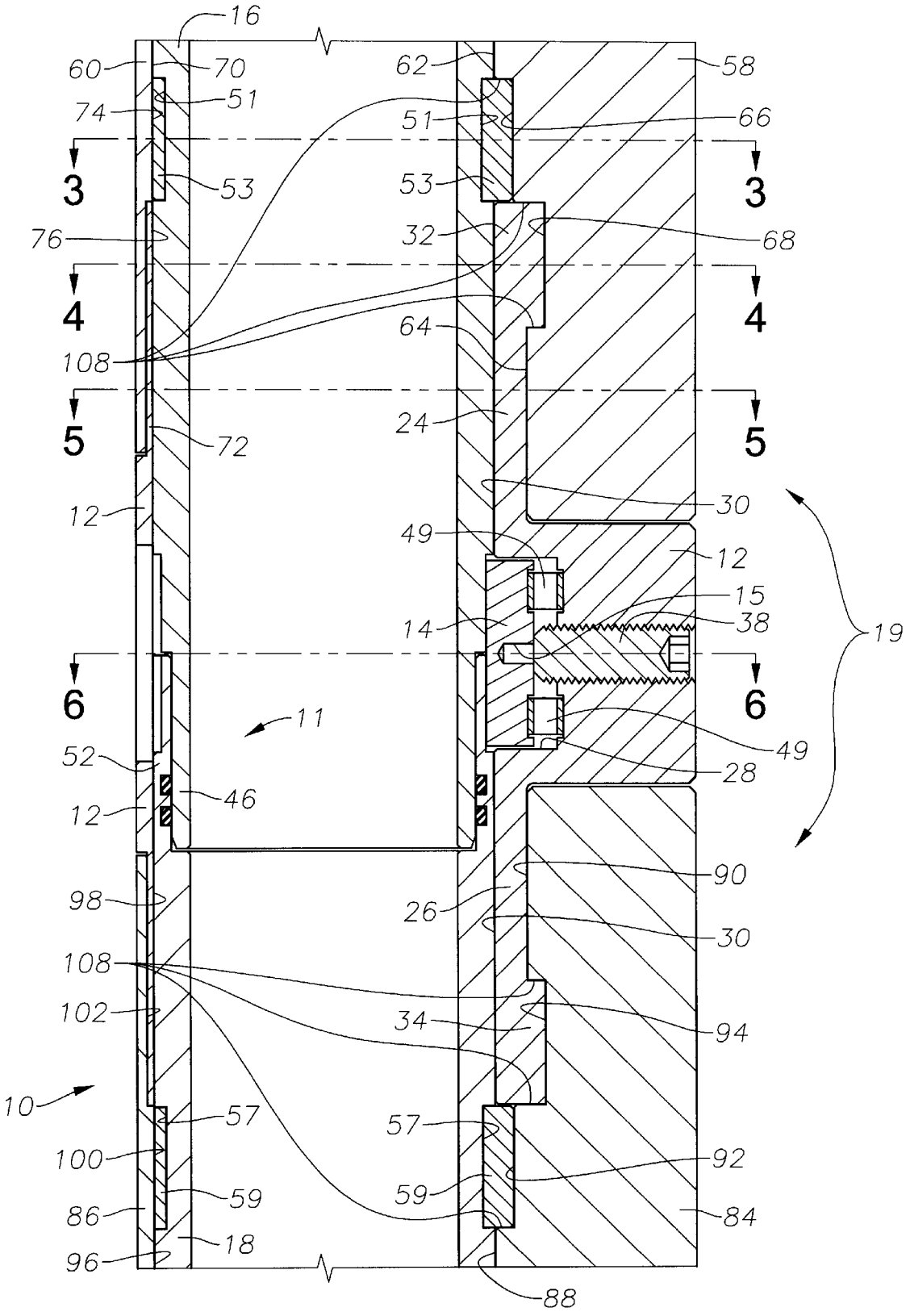
Figure 1C:
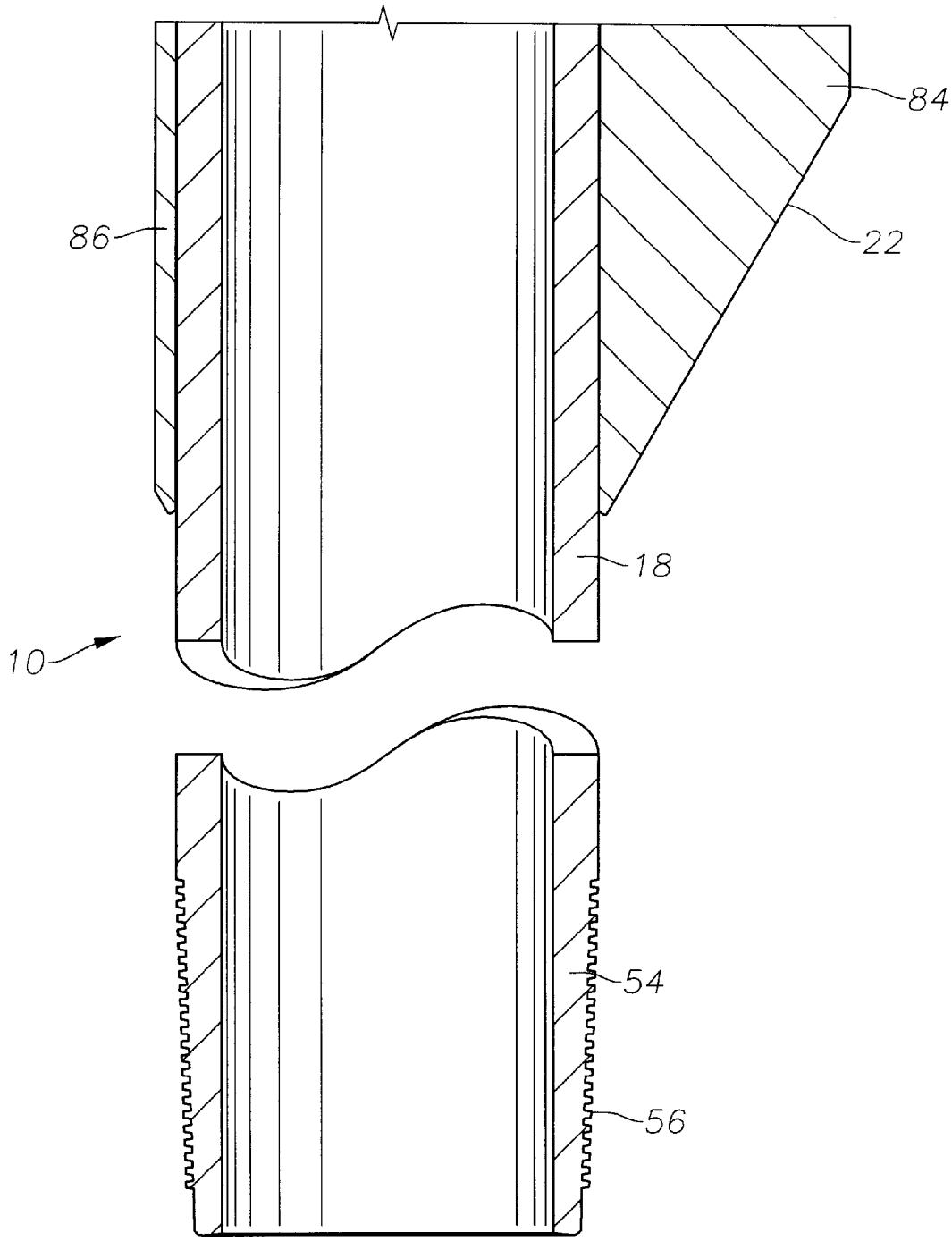
Figure 2:
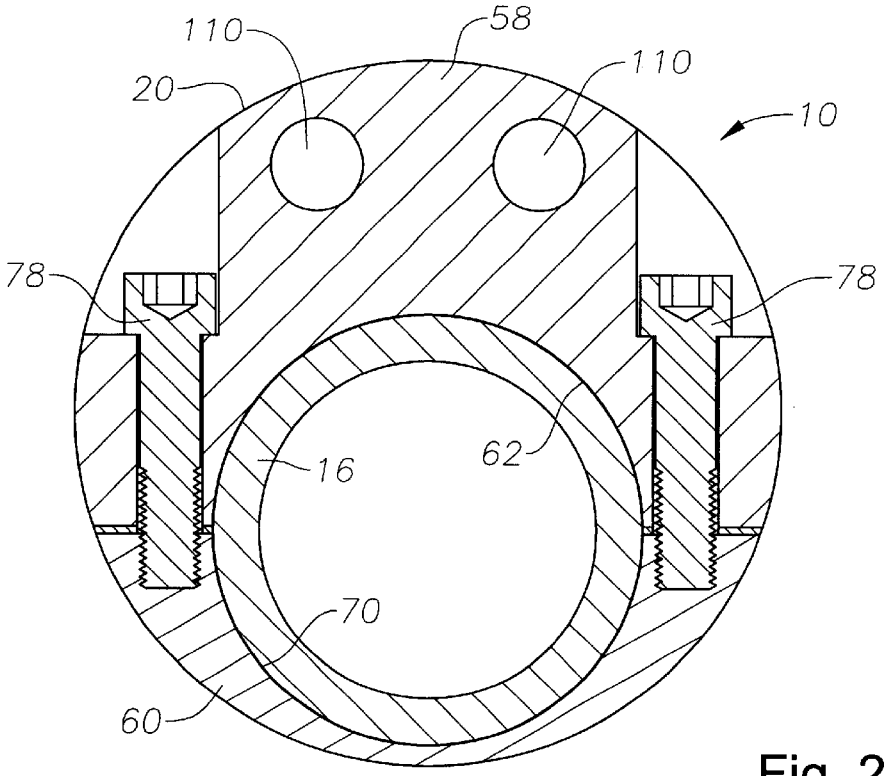
FIG. 2 is a cross-sectional view taken along line 2—2 of FIG. 1.
Figure 3:
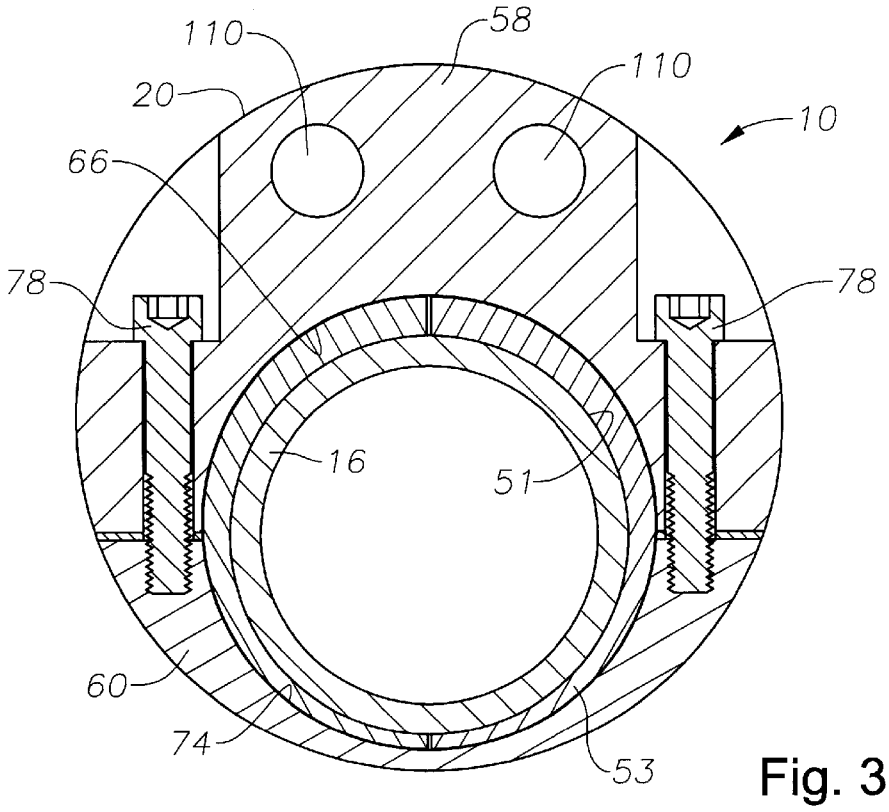
FIG. 3 is a cross-sectional view taken along line 3—3 of FIG. 1.

Referring to the drawings in detail, wherein like numerals denote identical elements throughout the several views, it can be seen with reference to FIG. 1A, 1B, and 1C that, in a broad aspect, the orienting and locking swivel 10 of the present invention may broadly include a locking ratchet housing 12, a tubular assembly 11, and a split housing assembly 19. Tubular assembly 11 preferably comprises a first tubular member 16 and a second tubular member 18. Split housing assembly 19 preferably comprises a first split housing 20 and a second split housing 22. Swivel 10 may also include a locking ratchet 14.

Figure 4:
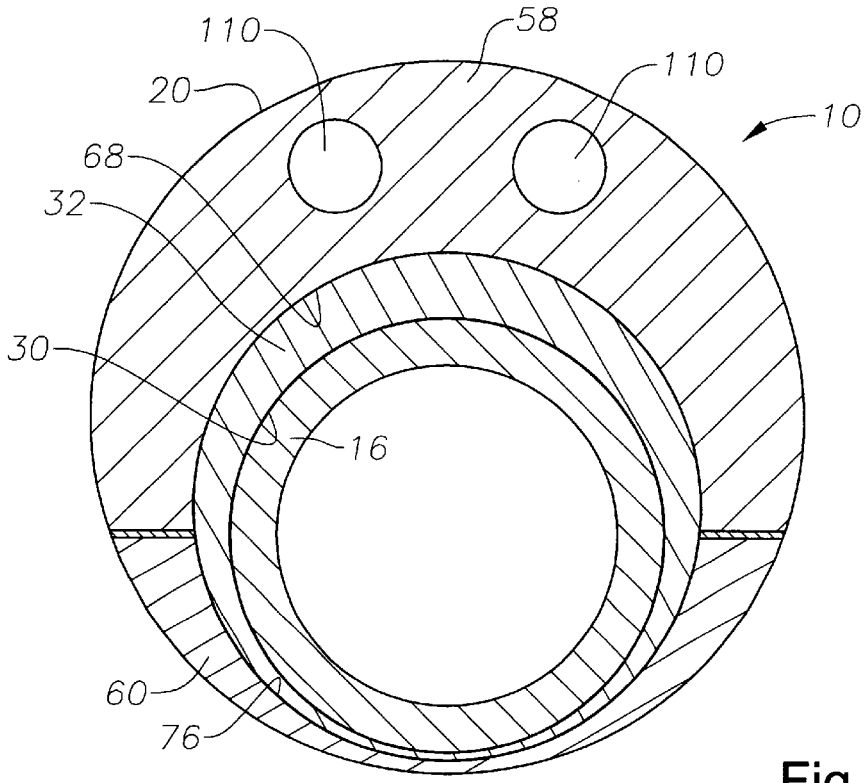
FIG. 4 is a cross-sectional view taken along line 4—4 of FIG. 1.
Figure 5:
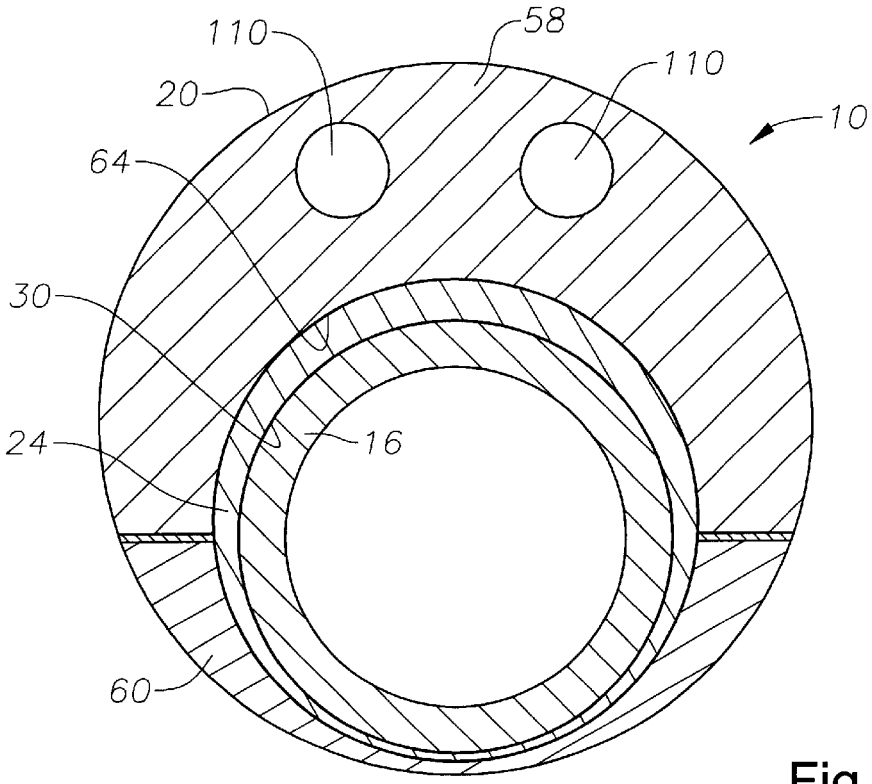
FIG. 5 is a cross-sectional view taken along line 5—5 of FIG. 1.

The locking ratchet housing 12 may include a first tubular extension 24, a second tubular extension 26, a locking ratchet recess 28, and a longitudinal bore 30. In a specific embodiment, the locking ratchet housing 12 may be eccentric. In a specific embodiment, the first tubular extension 24 may be eccentric (FIG. 5), and may further include a first flange 32 (FIG. 1B). As shown in FIG. 4, in a specific embodiment, the first flange 32 may be eccentric. In a specific embodiment, the second tubular extension 26 may be eccentric, and may further include a second flange 34. In a specific embodiment, the second flange 34 may be eccentric. In one embodiment, at least one of the first tubular extension 24, the first flange 32, the second tubular extension 26, and the second flange 34 is eccentric.

Figure 6:
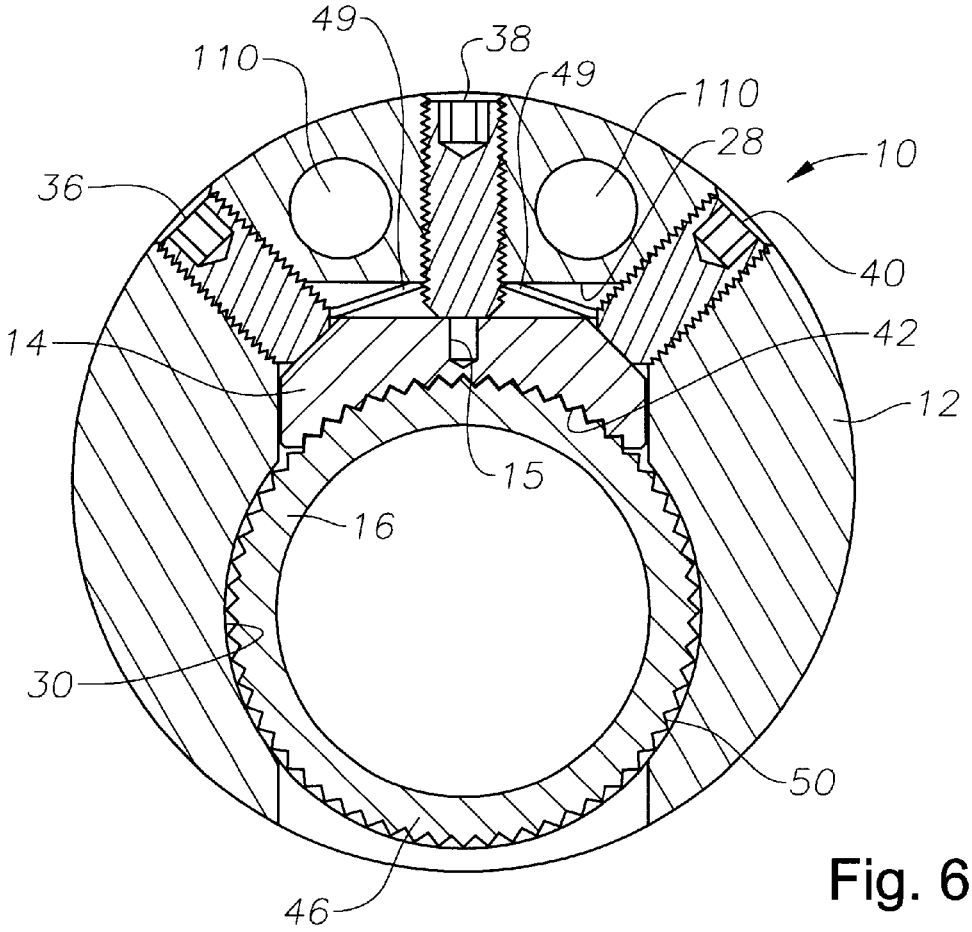
FIG. 6 is a cross-sectional view taken along line 6—6 of FIG. 1.

As shown in FIGS. 1B and 6, the locking ratchet 14 is disposed within the locking ratchet recess 28 and is releasably compressed against the first and second tubular members 16 and 18 by a means for releasably compressing. The means for releasably compressing preferably comprises at least one locking ratchet fastener, such as first, second, and third locking ratchet screws 36, 38, and 40. The means for releasably compressing may further define a means for releasably engaging the first and second tubular members 16 and 18 with the locking ratchet housing 12. Locking ratchet 14 includes a plurality of ratchet teeth 42 disposed on a concave surface thereof. The locking ratchet 14 may further include a threaded bore 15, the purpose of which will be described below.

Referring to FIGS. 1A–1C, the first tubular member 16 includes a first end 44 and a second end 46, and is partially disposed within the longitudinal bore 30 of the locking ratchet housing 12. As shown in FIG. 1A, the first end 44 of the first tubular member 16 is adapted (as by threads 48) for connection to a first section of well tubing (not shown). As shown in FIG. 6, the second end 46 of the first tubular member 16 preferably includes a plurality of ratchet teeth 50 for releasable engagement with the plurality of ratchet teeth 42 on the locking ratchet 14. As shown in FIG. 1B, the first tubular member 16 may further include an annular recess 51 in which a first split ring 53 may be disposed, the purpose of which will be explained below. In a specific embodiment, the first split ring 53 may be eccentric. In a specific embodiment, the first split ring 53 may contact the first flange 32.

Referring again to FIG. 1B, the second tubular member 18 may include a first end 52 and a second end 54 (see FIG. 1C), may be coaxially aligned with the first tubular member 16, and may be partially disposed within the longitudinal bore 30 of the locking ratchet housing 12. The first end 52 of the second tubular member 18 preferably includes a plurality of ratchet teeth (like the teeth 50 on the first tubular member 16) for releasable engagement with the plurality of ratchet teeth 42 on the locking ratchet 14. As shown in FIG. 1C, the second end 54 of the second tubular member 18 is adapted (as by threads 56) for connection to a second section of well tubing (not shown). As shown in FIG. 1B, the second tubular member 18 may further include an annular recess 55 in which a second split ring 59 may be disposed, the purpose of which will be described below. In a specific embodiment, the second split ring 59 may be eccentric. In a specific embodiment, the second split ring 59 may contact the second flange 34.

A means for biasing biases the locking ratchet teeth 42 into engagement with the ratchet teeth (e.g., 50) on the first and second tubular members 16 and 18. Preferably, the means for biasing comprises a spring 49 that is disposed within the locking ratchet recess 28 of the locking ratchet housing 12 to bias the locking ratchet teeth 42 into engagement with the ratchet teeth (e.g., 50) on the first and second tubular members 16 and 18.

In the preferred embodiment, at least one, and preferably both of the first tubular member 16 and the second tubular member 18 include a plurality of ratchet teeth 50, positioned as previously disclosed. In the preferred embodiment, at least one, and preferably both of the first split ring 53 and the second split ring 59 are eccentric. The first end 52 of the second tubular member 18 may be sealably engageable with the second end 46 of the first tubular member 16.

Figure 7A:
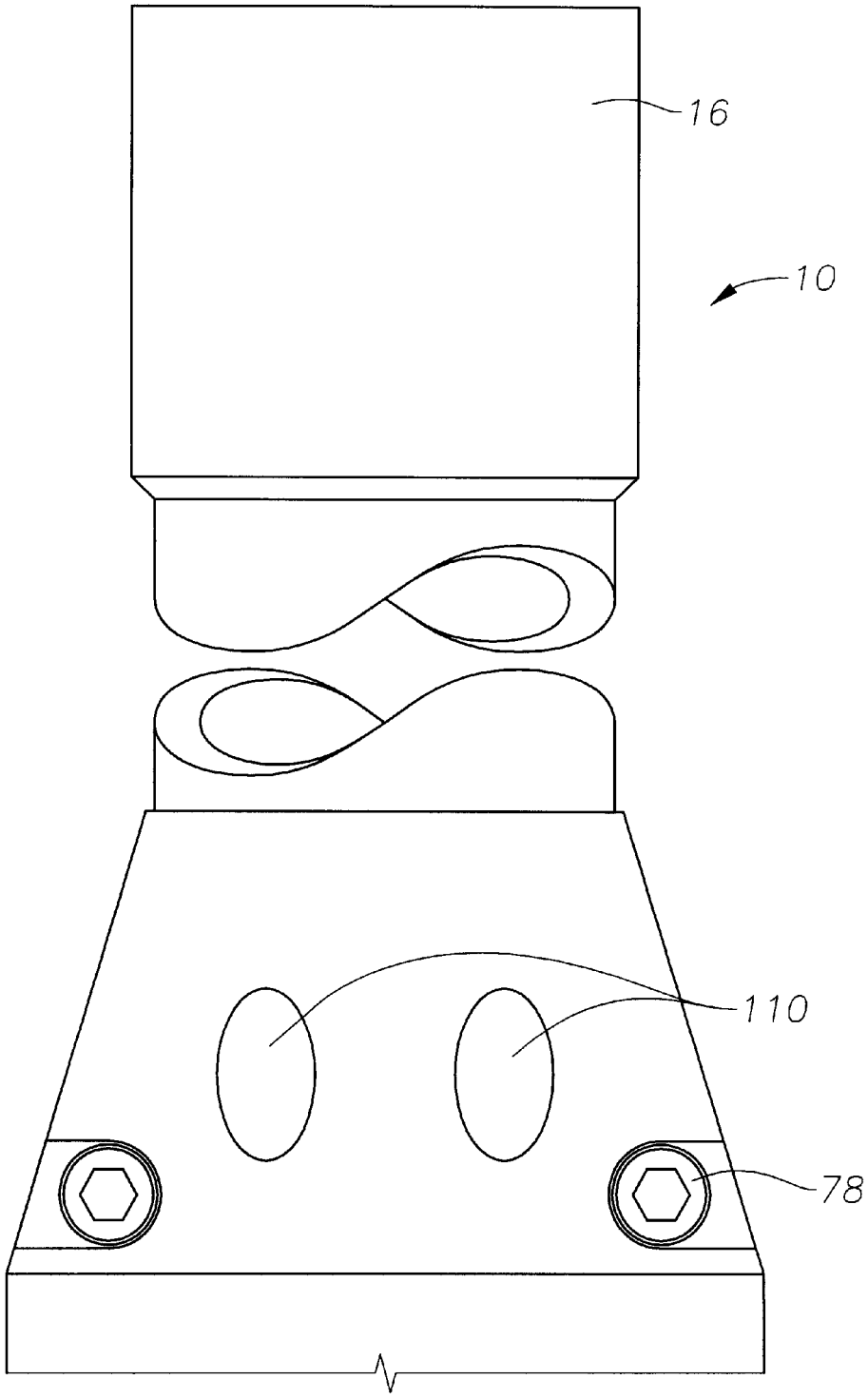
FIGS. 7A–7C illustrate a longitudinal side view of the present invention.
Figure 7B:
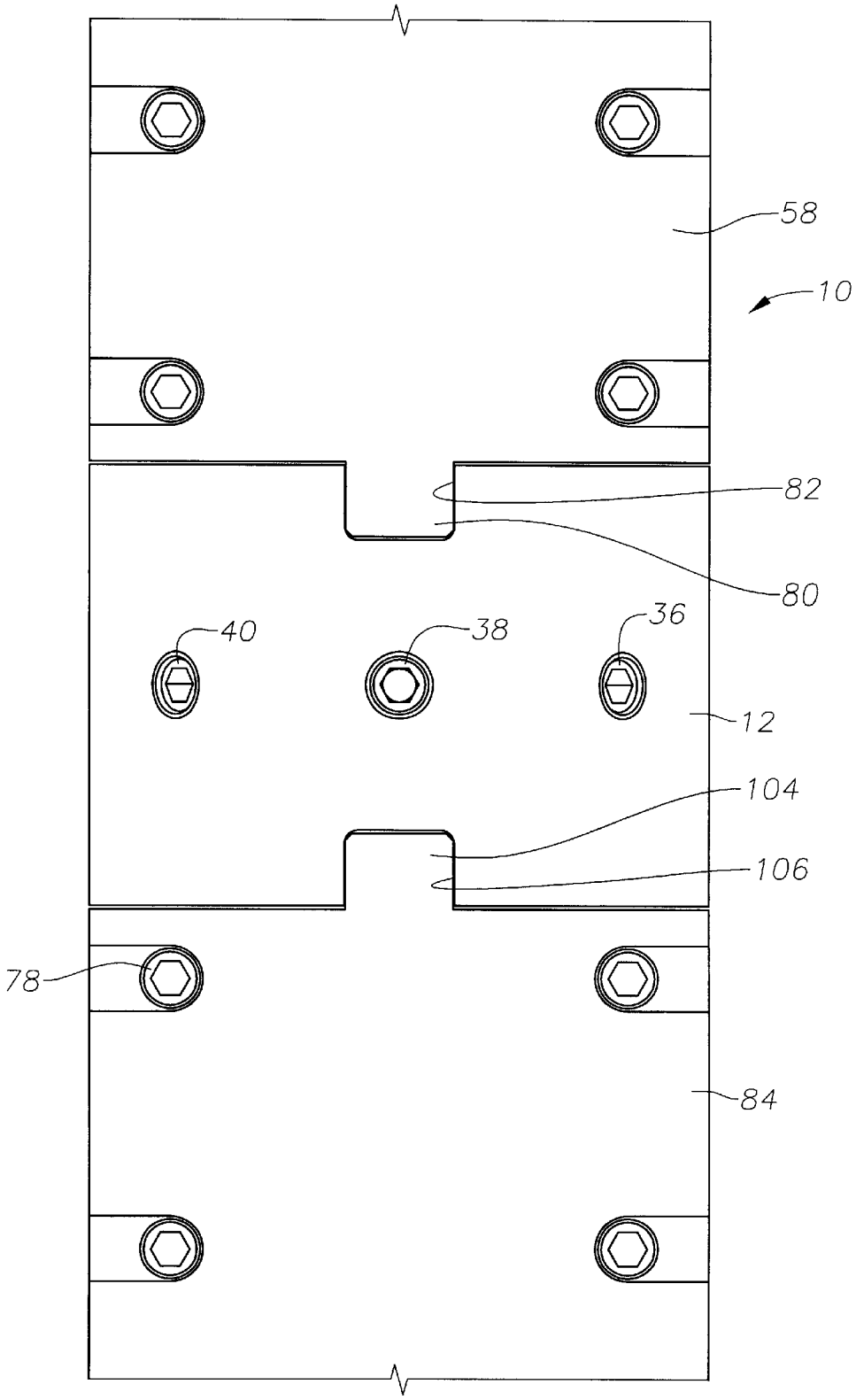

With reference to FIGS. 1B and 2–5, the first split housing 20 may be eccentric, and may include a first main body 58 and a first mating body 60. The first main body 58 may include a first concave surface 62 for mating with the first tubular member 16 (best shown in FIG. 2) and a second concave surface 64 for mating with the first tubular extension 24 of the locking ratchet housing 12 (best shown in FIG. 5). As shown in FIG. 1B, the first main body 58 may also include a first arcuate recess 66 (see also FIG. 3) for receiving the first split ring 53 and a second arcuate recess 68 (see also FIG. 4) for receiving the flange 32 on the first tubular extension 24 of the locking ratchet housing 12. The first mating body 60 may include a first concave surface 70 for mating with the first tubular member 16 and a second concave surface 72 for mating with the first tubular extension 24 of the locking ratchet housing 12. The first mating body 60 may also include a first arcuate recess 74 (see FIG. 3) for receiving the first split ring 53 and a second arcuate recess 76 (see FIG. 4) for receiving the flange 32 on the first tubular extension 24 of the locking ratchet housing 12. The first main body 58 and the first mating body 60 are releasably attached together, as by screws 78, as shown in FIGS. 2, 3, and 7A–7C. In this manner, the first split housing 20 is releasably engageable with the first tubular member 16. As shown in FIG. 7B, the first main body 58 includes a locking finger 80 for mating with a first locking notch 82 in the locking ratchet housing 12. In this manner, the first split housing 20 may be engaged with the locking ratchet housing 12, so as to prevent relative rotational movement therebetween.

Figure 7C:
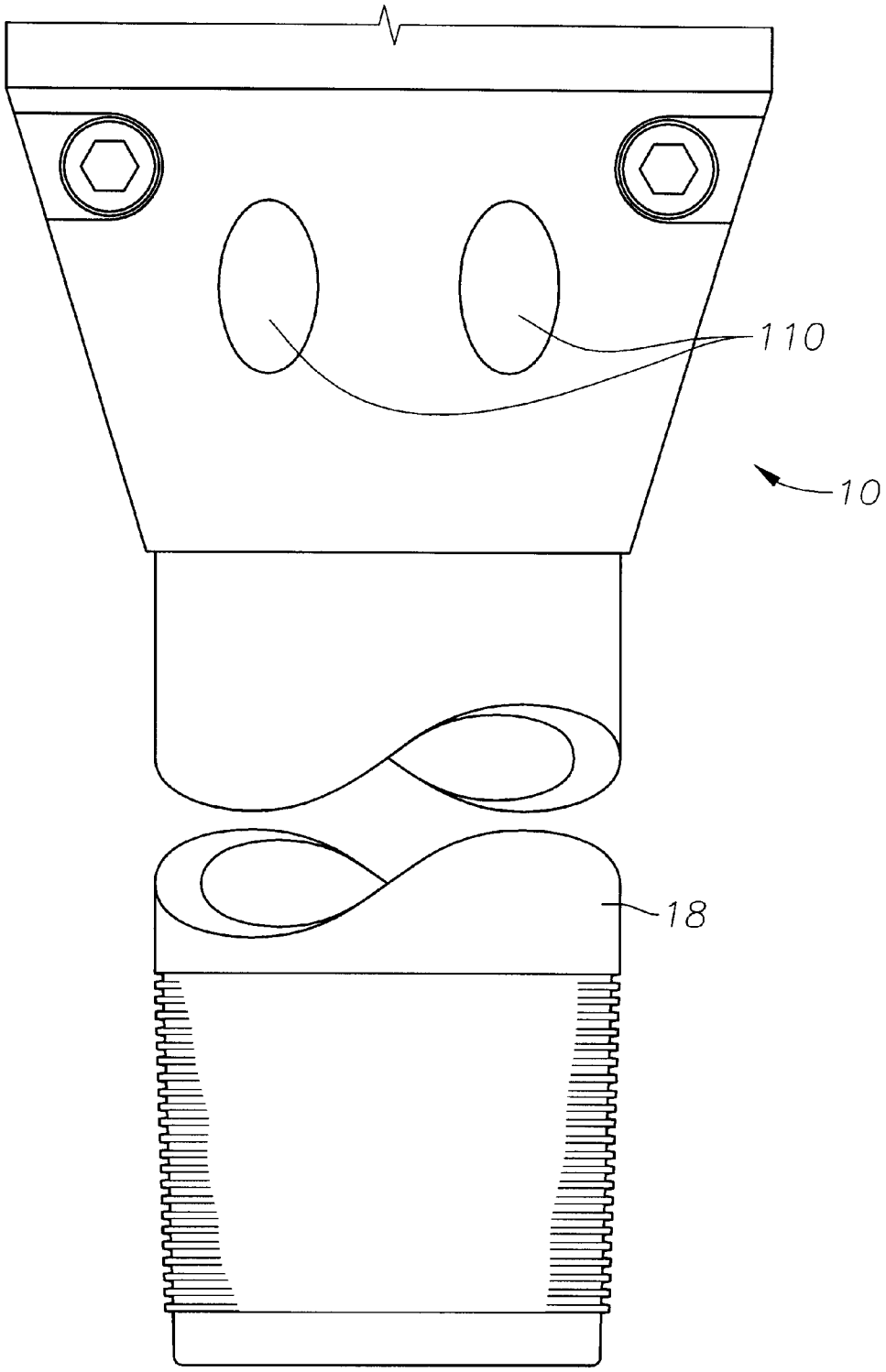

Referring to FIG. 1B, the second split housing 22 may be eccentric, and may include a second main body 84 and a second mating body 86. The second main body 84 may include a first concave surface 88 for mating with the second tubular member 18 and a second concave surface 90 for mating with the second tubular extension 26 of the locking ratchet housing 12. The second main body 84 may also include a first arcuate recess 92 for receiving the second split ring 59 and a second arcuate recess 94 for receiving the flange 34 on the second tubular extension 26 of the locking ratchet housing 12. The second mating body 86 may include a first concave surface 96 for mating with the second tubular member 18 and a second concave surface 98 for mating with the second tubular extension 26 of the locking ratchet housing 12. The second mating body 86 may also include a first arcuate recess 100 for receiving the second split ring 59 and a second arcuate recess 102 for receiving the flange 34 on the second tubular extension 26 of the locking ratchet housing 12. The second main body 84 and the second mating body 86 may be releasably attached together, as by screws 78, as shown in FIGS. 7A–7C. In this manner, the second split housing 22 is releasably engageable with the second tubular member 18. As shown in FIG. 7B, the second main body 84 may include a locking finger 104 for mating with a second locking notch 106 in the locking ratchet housing 12. In this manner, the second split housing 22 is engaged with the locking ratchet housing 12, so as to prevent relative rotational movement there between.

As will be apparent to those of ordinary skill in the art, in view of the below explanation of the operation of the swivel 10 of the present invention, the split rings 53, 59 and the flanges 32, 34 (along with the respective recesses 51/66/74, 68/76, 94/98, 57/92/100 in which they reside) function as tension and compression bearing members, as indicated by arrows 108. Thus, the split rings 53 and 59 and associated recesses comprise a means connected to the first and second tubular members 16 and 18 for transferring loads between the first and second tubular members 16 and 18. And, the flanges 32 and 34 and associated recesses comprises a means connected to the locking ratchet housing 12 for transferring loads between the first and second tubular members 16 and 18.

In operation, the orienting and locking swivel 10 of the present invention may be used to align eccentric well tools that are connected to a well tubing, and may do so while at the same time connecting the intermediate tubing string so that all production bores (i.e., in the eccentric well tools, in the swivel 10, and in the intermediate tubing string) are substantially coaxially aligned. For example, if a particular well completion (not shown) calls for the use of two side pocket mandrels (not shown), the orienting and locking swivel 10 may be used to align the side pockets of the two side pocket mandrels, so that the upper side pocket is located directly above the lower side pocket; and the swivel 10 may accomplish such alignment while at the same time maintaining a "straight" production bore (i.e., the production bores are substantially coaxial, as described above). To reach this result, when the first, or lower, side pocket mandrel is connected to a section of well tubing at the earth's surface, a registration mark is affixed at the well surface to indicate the orientation of the first, or lower, side pocket within the well casing. Then, after additional sections of well tubing, and perhaps other well tools, are connected to the tubing string, and it is desired to connect the second side pocket mandrel to the well tubing, one end of the orienting and locking swivel 10 of the present invention is first connected to the well tubing and then the second side pocket mandrel is connected to the other end of the orienting and locking swivel 10. More particularly, for example, with reference to FIGS. 1A–1C, the second end 54 of the second tubular member 18 (FIG. 1C) may be connected to the well tubing, and then the first end 44 of the first tubular member 16 may be connected to the second side pocket mandrel, either directly or with one or more well tools or sections of tubing disposed therebetween. As more fully explained below, the locking and orienting swivel 10 is then used to (a) permit the second, or upper, side pocket mandrel to rotate relative to the first, or lower, side pocket mandrel, (b) align the first and second side pockets (by reference to the registration mark) and/or coaxially align the production bores of the side pocket mandrels and the intermediate tubing string, including the production bore of the swivel 10, and then (c) prevent relative rotation between the first and second side pocket mandrels. Thus, swivel 10 may also generally comprise a means connected between two eccentric well tools for locking and orienting the well tools in the tubing string.

With reference to FIGS. 6 and 7B, after the swivel 10 is connected between the first and second side pocket mandrels, the first and third locking ratchet screws 36 and 40 are retracted so as to permit full movement of the locking ratchet 14 within the locking ratchet recess 28 in the locking ratchet housing 12, and the second locking ratchet screw 38 is removed. A grasping screw (not shown), or other means known to those of ordinary skill in the art, may then be inserted through the space normally occupied by the second locking ratchet screw 38, threaded into the threaded bore 15, and used to pull the locking ratchet 14 away from the first and second tubular members 16 and 18, so as to disengage the locking ratchet teeth 42 from the ratchet teeth (e.g, 50) on the first and second tubular members 16 and 18. Threaded bore 15 and the corresponding grasping screw therefore comprise a means for disengaging the locking ratchet 14 from the first and second tubular members 16 and 18. The screws 78 should be sufficiently loosened so as to permit rotation of at least one of the first and second tubular members 16 and 18 within the first and second split housings 20 or 22, respectively. The side pocket of the second, or upper, side pocket mandrel is rotated into alignment with the registration mark, which, as explained above, represents the angular position of the side pocket on the first, or lower, side pocket mandrel. After the first and second side pockets have been aligned, the locking ratchet 14 (FIGS. 1B and 6) is allowed to move back towards the first and second tubular members 16 and 18 (e.g., under force of the spring 49), thereby bringing the locking ratchet teeth 42 on the locking ratchet 14 into engagement with the ratchet teeth (e.g., 50) on the first and second tubular members 16 and 18. The grasping screw (not shown) may then be removed from the threaded bore 15 in the locking ratchet 14. Finally, the locking ratchet screws 36, 38, and 40 may be threaded into the locking ratchet housing 12 so as to securely engage the locking ratchet teeth 42 with the corresponding ratchet teeth on the first and second tubular members 16 and 18, and the screws 78 (see, e.g., FIG. 7B) are tightened so as to securely fasten the first and second split housings 20 and 22 to their corresponding tubular members 16 and 18.

As shown in FIGS. 2–6 and 7A–7C, the swivel 10 of the present invention may include at least one longitudinal passageway 110 through which one or more control lines may be passed, such as to transmit electrical or other signals between the earth's surface and various downhole tools and/or sensors, such as those used in "smart" or "intelligent" downhole well tools.

It is to be understood that the invention is not limited to the exact details of construction, operation, exact materials or embodiments shown and described, as obvious modifications and equivalents will be apparent to one skilled in the art. Accordingly, the invention is therefore to be limited only by the scope of the appended claims.

We claim:

1. An orienting and locking swivel, comprising:

a locking ratchet housing having a locking ratchet recess and a longitudinal bore;

a locking ratchet disposed within said locking ratchet recess and releasably secured to said locking ratchet housing;

a first tubular member partially disposed within said longitudinal bore of said locking ratchet housing, and releasably engageable with said locking ratchet;

a second tubular member partially disposed within said longitudinal bore of said locking ratchet housing, and releasably engageable with said locking ratchet;

a first split housing engaged with said locking ratchet housing and releasably engageable with said first tubular member; and a second split housing engaged with said locking ratchet housing and releasably engageable with said second tubular member.

2. The orienting and locking swivel of claim 1, wherein said locking ratchet housing is eccentric.

3. The orienting and locking swivel of claim 1, wherein said first and second split housings are eccentric.

4. The orienting and locking swivel of claim 1, wherein said locking ratchet housing further includes a first tubular extension having a first flange and a second tubular extension having a second flange, said first flange being disposed within an arcuate recess in said first split housing, and said second flange being disposed within an arcuate recess in said second split housing.

5. The orienting and locking swivel of claim 4, wherein at least one of said first tubular extension, said first flange, said second tubular extension, and said second flange is eccentric.

6. The orienting and locking swivel of claim 1, wherein said locking ratchet is releasably compressed against said first and second tubular members by at least one locking ratchet fastener.

7. The orienting and locking swivel of claim 1, further including means for releasably compressing said locking ratchet against said first and second tubular members.

8. The orienting and locking swivel of claim 1, wherein said locking ratchet includes a plurality of ratchet teeth releasably engageable with a plurality of ratchet teeth on at least one of said first and second tubular members.

9. The orienting and locking swivel of claim 8, wherein said plurality of ratchet teeth on said locking ratchet are disposed on a concave surface of said locking ratchet.

10. The orienting and locking swivel of claim 8, further including means for biasing said locking ratchet teeth into engagement with said ratchet teeth on said first and second tubular members.

11. The orienting and locking swivel of claim 1, further including means for disengaging said locking ratchet from said first and second tubular members.

12. The orienting and locking swivel of claim 1, further including at least one split ring disposed within (a) at least one arcuate recess in at least one of said first and second split housings and (b) at least one annular recess in at least one of said first and second tubular members.

13. The orienting and locking swivel of claim 12, wherein at least one of said first and second split rings is eccentric.

14. The orienting and locking swivel of claim 1, wherein said first and second tubular members are substantially coaxially aligned.

15. The orienting and locking swivel of claim 1, wherein said first split housing includes a first main body and a first mating body, each having a first concave surface for mating with said first tubular member and a second concave surface for mating with a first tubular extension on said locking ratchet housing, and said second split housing includes a second main body and a second mating body, each having a first concave surface for mating with said second tubular member and a second concave surface for mating with a second tubular extension on said locking ratchet housing.

16. The orienting and locking swivel of claim 15, wherein said first main body and said first mating body are releasably secured together about said first tubular member, and said second main body and said second mating body are releasably secured together about said second tubular member.

17. The orienting and locking swivel of claim 1, wherein said first split housing includes a locking finger for cooperable engagement with a first locking notch on said locking ratchet housing, and said second split housing includes a locking finger for cooperable engagement with a second locking notch on said locking ratchet housing.

18. The orienting and locking swivel of claim 1, further including at least one longitudinal passageway disposed therein for passage of at least one control line.

19. An orienting and locking swivel, comprising:

a locking ratchet housing having a locking ratchet recess and a longitudinal bore;

a locking ratchet disposed within said locking ratchet recess, and having a plurality of ratchet teeth disposed thereon;

a first tubular member having a plurality of ratchet teeth releasably engageable with said plurality of ratchet teeth on said locking ratchet, and being partially disposed within said longitudinal bore of said locking ratchet housing;

a second tubular member having a plurality of ratchet teeth releasably engageable with said plurality of ratchet teeth on said locking ratchet, and being partially disposed within said longitudinal bore of said locking ratchet housing;

a first split housing engaged with said locking ratchet housing, and having a first main body and a first mating body, each of said first main body and first mating body having a first concave surface for mating with said first tubular member and a second concave surface for mating with a first tubular extension of said locking ratchet housing; and a second split housing engaged with said locking ratchet housing, and having a second main body and a second mating body, each of said second main body and second mating body having a first concave surface for mating with said second tubular member and a second concave surface for mating with a second tubular extension of said locking ratchet housing.

20. The orienting and locking swivel of claim 19, wherein said locking ratchet housing is eccentric.

21. The orienting and locking swivel of claim 19, wherein said first and second split housings are eccentric.

22. The orienting and locking swivel of claim 19, wherein said first tubular extension further includes a first flange and said second tubular extension further includes a second flange, said first flange being disposed within arcuate recesses in said first main body and said first mating body, and said second flange being disposed within arcuate recesses in said second main body and said second mating body.

23. The orienting and locking swivel of claim 22, wherein at least one of said first tubular extension, said first flange, said second tubular extension, and said second flange is eccentric.

24. The orienting and locking swivel of claim 19, further including a first and a second split ring, said first split ring being disposed within an annular recess in said first tubular member and within at least one arcuate recess in one of said first main body and said first mating body, and said second split ring being disposed within an annular recess in said second tubular member and within at least one arcuate recess in one of said second main body and said second mating body.

25. The orienting and locking swivel of claim 24, wherein at least one of said first and second split rings is eccentric.

26. The orienting and locking swivel of claim 19, wherein said first main body and said first mating body are releasably secured together about said first tubular member, and said second main body and said second mating body are releasably secured together about said second tubular member.

27. The orienting and locking swivel of claim 19, wherein said first split housing includes a locking finger for cooperable engagement with a first locking notch on said locking ratchet housing, and said second split housing includes a locking finger for cooperable engagement with a second locking notch on said locking ratchet housing.

28. The orienting and locking swivel of claim 19, wherein said locking ratchet is releasably compressed against said first and second tubular members by at least one locking ratchet fastener.

29. The orienting and locking swivel of claim 19, further including means for releasably compressing said locking ratchet against said first and second tubular members.

30. The orienting and locking swivel of claim 19, wherein said plurality of ratchet teeth on said locking ratchet are disposed on a concave surface of said locking ratchet.

31. The orienting and locking swivel of claim 19, further including means for biasing said locking ratchet teeth into engagement with said ratchet teeth on said first and second tubular members.

32. The orienting and locking swivel of claim 19, further including means for disengaging said locking ratchet from said first and second tubular members.

33. The orienting and locking swivel of claim 19, wherein said first and second tubular members are substantially coaxially aligned.

34. The orienting and locking swivel of claim 19, further including at least one longitudinal passageway disposed therein for passage of at least one control line.

35. An orienting and locking swivel, comprising:

a locking ratchet housing having a longitudinal bore;

a first tubular member partially disposed within said longitudinal bore of said locking ratchet housing, and releasably engageable with said locking ratchet housing;

a second tubular member partially disposed within said longitudinal bore of said locking ratchet housing, and releasably engageable with said locking ratchet housing;

a first split housing engaged with said locking ratchet housing and releasably engageable with said first tubular member; and a second split housing engaged with said locking ratchet housing and releasably engageable with said second tubular member.

36. The orienting and locking swivel of claim 35, further including means for releasably engaging said first and said second tubular members with said locking ratchet housing.

37. The orienting and locking swivel of claim 35, further including means connected to said first and said second tubular members for transferring loads between said first and said second tubular members.

38. The orienting and locking swivel of claim 35, further including means connected to said locking ratchet housing for transferring loads between said first and said second tubular members.

39. The orienting and locking swivel of claim 35, further including a locking ratchet disposed within a locking ratchet recess in said locking ratchet housing, said locking ratchet being releasably engageable with said first and second tubular members.

40. The orienting and locking swivel of claim 39, wherein said locking ratchet includes a plurality of ratchet teeth releasably engageable with a plurality of ratchet teeth on at least one of said first and second tubular members.

41. The orienting and locking swivel of claim 35, wherein said first split housing includes a first main body and a first mating body, each having a first concave surface for mating with said first tubular member and a second concave surface for mating with a first tubular extension on said locking ratchet housing, and said second split housing includes a second main body and a second mating body, each having a first concave surface for mating with said second tubular member and a second concave surface for mating with a second tubular extension on said locking ratchet housing.

42. The orienting and locking swivel of claim 35, wherein said first split housing includes a locking finger for cooperable engagement with a first locking notch on said locking ratchet housing, and said second split housing includes a locking finger for cooperable engagement with a second locking notch on said locking ratchet housing.

43. An orienting and locking swivel, comprising:

a locking ratchet housing having a longitudinal bore;

a tubular assembly partially disposed within said longitudinal bore of said locking ratchet housing, and releasably engageable with said locking ratchet housing; and a split housing assembly engaged with said locking ratchet housing and releasably engageable with said tubular member assembly.

* * * * *